United States Patent [19]

Dossey et al.

[11] Patent Number: 4,706,949

[45] Date of Patent: Nov. 17, 1987

[54] VISE JAW SUPPORT SYSTEM AND INTERCHANGEABLE VISE JAWS THEREFOR

[76] Inventors: Robert L. Dossey, 1975 S. Zuni, Denver, Colo. 80223; Truman J. Collins, 6231 Federal Blvd. #3, Denver, Colo. 80221

[21] Appl. No.: 810,873

[22] Filed: Dec. 17, 1985

[51] Int. Cl.[4] ..... B25B 1/24

[52] U.S. Cl. ..... 269/283

[58] Field of Search ..... 269/279-284, 269/244-248, 285, 902, 900; 33/174 S; 51/DIG. 31; 81/180 B

[56] References Cited

U.S. PATENT DOCUMENTS

| | | | |
|---|---|---|---|
| 164,291 | 6/1875 | Gleason et al. | 269/283 |
| 445,983 | 2/1891 | Dwight . | |
| 876,228 | 1/1908 | Pereles . | |
| 969,986 | 9/1910 | Sawaya | 269/282 |
| 1,397,409 | 11/1921 | Duwelius | 269/280 |
| 1,883,335 | 10/1932 | Braden | 269/283 |
| 3,002,726 | 10/1961 | Ford . | |
| 3,565,417 | 2/1971 | Degle | 269/283 |
| 3,578,308 | 5/1971 | Jesionowski | 269/248 |
| 4,078,782 | 3/1978 | Carlson | 269/283 |
| 4,191,367 | 3/1980 | Speiser et al. . | |
| 4,251,066 | 2/1981 | Bowling . | |
| 4,413,818 | 11/1983 | Lenz | 269/244 |
| 4,437,654 | 3/1984 | Chiappetti . | |
| 4,448,405 | 5/1984 | Cipolla | 269/280 |

OTHER PUBLICATIONS

Disclosure Document (Truman J. Collins), Ser. No. 124,621, filed Feb. 13, 1984.

*Primary Examiner*—Robert C. Watson
*Attorney, Agent, or Firm*—John E. Reilly

[57] ABSTRACT

A machine vise unit herein first and second jaws are mounted on a vise jaw support bed in facing relation to one another with the first jaw fixedly mounted via preferred and modified forms of an adaptor block to the bed, and the second jaw slidably mounted on the bed for movement toward and away from the first jaw. Interchangeable vise jaws can be readily substituted for the first jaw and firmly secured to the support bed in carrying out different machining operations.

20 Claims, 17 Drawing Figures

VISE JAW SUPPORT SYSTEM AND INTERCHANGEABLE VISE JAWS THEREFOR

Specification

This invention relates to vise jaw support systems, and more particularly relates to a novel and improved jaw support structure and interchangeable vise jaws for holding or clamping a wide variety of workpieces during machining operations.

BACKGROUND AND FIELD OF INVENTION

Machine vises for heavy duty machining operations impose particular requirements on the jaw support structure and vise jaw itself to hold a workpiece fixed or immobile both in the processing of clamping the workpiece in place and during machining operations. One such machine vise which is characterized by its ability to eliminate shifting or tilting of the workpiece is that sold by Kurt Manufacturing Company under the trademark "ANGLOCK®". In the ANGLOCK® vise, the jaw support bed has a master or stationary jaw affixed to one end, and a slidable jaw is characterized by having a spherical segment which upon the application of forces to the jaw tends to draw the jaw downwardly against the base or bed, as opposed to tilting upwardly. Nevertheless, the ANGLOCK® vise, as is the case with so many other machine vises, fails to make adequate provision for interchangeable use of different vise jaws according to the machine operation to be performed and the configuration of the particular workpiece to be machined or clamped. Not only is the setup procedure laborious and time-consuming, but has definite limitations in terms of the number of different types of vise jaws which can be mounted on the jaw support bed.

It is therefore proposed to facilitate attachment of different vise jaws, including soft jaws, to a common jaw support bed, by substituting a novel and improved jaw adaptor assembly for the existing stationary jaw and which will accommodate any number of different types of vise jaws. Further, in heavy duty machining operations, it is important that each stationary jaw be firmly anchored to the jaw support bed so as to effectively form a unitary part of the bed and to transmit forces directly into the jaw support bed while maintaining accurate alignment of the workpiece; and it is equally important that the set-up time be held to a minimum in accomplishing the foregoing.

In the past, it has been proposed to employ a combination of key members and connecting bolts for interchangeable connection of jaw sets. For example, U.S. Pat. No. 4,191,367 to A. S. Speiser et al utilizes a combination of key members and connecting bolts for mounting of a master jaw and movable jaw on the bed of a jaw support structure as well as utilizing a combination of interfitting dovetail grooves and projections together with the insertion of threaded fasteners for connection of a vise jaw to a master jaw. Various different approaches have been previously followed in the interchangeable attachment of different vise jaws to a master jaw in a vise system, representative patents being U.S. Pat. Nos. 4,437,654 to P. Chiappetti; 876,228 to A. J. Pereles; and C. L. Bowling. Generally, such approaches may be characterized either as direct threaded connection by means of horizontally directed bolt members extending between the master jaw and vise jaw, some type of snapfit connection as represented by Chiappetti or interfitting keys and keyways as represented by U.S. Pat. No. 164,291 to E. Gleason et al. Other patents of interest are U.S. Pat. Nos. 445,983 to W. B. Dwight and 3,002,726 to D. Ford.

SUMMARY OF THE INVENTION

It is therefore an object of the present invention to provide for a novel and improved vise jaw mounting and support system for interchangeable mounting of different vise jaws; and further wherein the mounting and support means are capable of solidly anchoring each vise jaw in place and preventing misalignment of the workpiece.

It is another object of the present invention to provide for a novel and improved jaw support system adapted for heavy duty machining operations and which vise jaw system is capable of accommodating a plurality of different vise jaws each of which can be rapidly set up for a given job in a minimum number of steps while avoiding the use of removable fasteners, such as for instance, threaded connecting bolts.

A further object of the present invention is to provide for accurate but rapid setup of each of a plurality of interchangeable vise jaws through the simple expedient of a single clamping operation which will apply balanced clamping pressure over a wide area of the vise jaw with even distribution of forces into the jaw support structure.

Another object of the present invention is to provide for a novel and improved multiple parts, interchangeable vise jaw for gang machining of a number of parts at one time.

A still further object of the present invention is to provide for an interchangeable jaw having intersecting V-shaped notches on its work surface to establish three-point clamping of curved or circular members during machining operations.

Another object of the present invention is to provide for a novel and improved interchangeable vise jaw which is capable of supporting a workpiece to carry out machining of different angles or chamfers thereon.

In accordance with the present invention, there has been devised a machine vise unit in which first and second jaws are mounted on a vise jaw support bed in facing relation to one another, the first jaw being fixedly mounted via an adaptor block to the bed and the second jaw slidably mounted on the bed for movement toward and away from the first jaw. In a preferred form, a mounting block insert between the adaptor block and first jaw has a dovetail end surface and an opposed, squared end surface of the same cross-section as a vertical groove on the first jaw and is positioned in the groove for adjustable sliding movement of the dovetail end surface toward and away from the groove by adjustable connecting means between the adaptor block, first jaw and the mounting block insert. The first jaw may be defined by one of a plurality of interchangeable vise jaws having a flat attaching end surface with a vertical dovetail groove therein which is complementary to the dovetail end surface of the mounting block insert for releasable insertion of the dovetail end surface into the vertical dovetail groove, the adjustable connecting means being operative to slide the dovetail end surface toward the groove in order to draw the interchangeable vise jaw mounted on the dovetail end surface into clamping engagement with the adaptor block.

Each of the interchangeable vise jaws has a flat, vertical workpiece-engaging surface opposite to the attaching end surface of the vise jaw. In one embodiment, the workpiece-engaging surface includes a vertical stepped portion extending parallel to the dovetail groove on the attaching end surface. In another of the interchangeable vise jaws, the workpiece-engaging surface is provided with a plurality of V-shaped slots which intersect one another. In another embodiment, the workpiece-engaging surface has a pair of slots extending in mutually perpendicular relation and one of the slots extending vertically in spaced parallel relation to the dovetail groove on the attaching end surface. In still another embodiment, the workpiece-engaging surface is of generally U-shaped configuration having opposite sides extending in a direction away from the attaching end surface and one of the opposite sides provided with adjustable clamping members.

Another form of interchangeable vise jaw has a workpiece-engaging surface and angled setting arm adjustably mounted with respect to a channel on the workpiece-engaging surface to set the angle of machining for a workpiece supported by the angle setting arm. In each form, the interchangeable vise jaw can be rapidly set up in a one-step clamping operation.

The above and other objects, advantages and features of the present invention will become more readily understood and appreciated from a consideration of the following detailed description of a preferred embodiment when taken together with the accompanying drawings in which:

DETAILED DESCRIPTION OF THE PREFERRED EMBODIMENT

Figure 1:
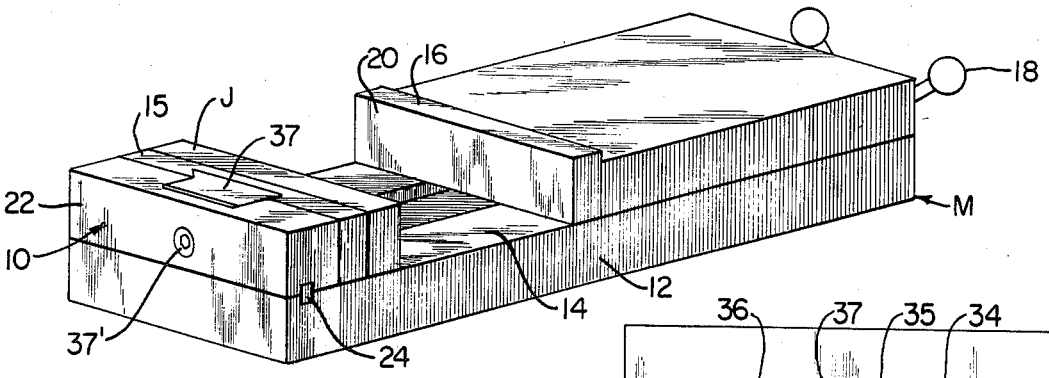
FIG. 1 is a perspective view of a preferred form of machine vise unit including a standard vise jaw support bed in accordance with the present invention.
Figure 2:
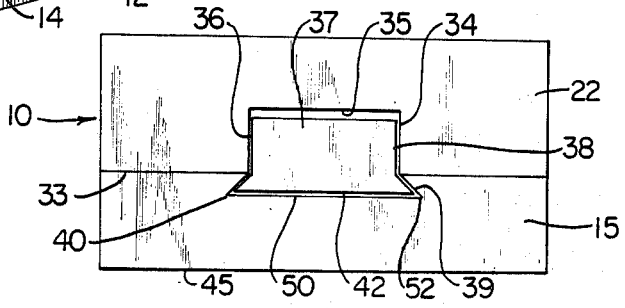
FIG. 2 is a top plan view of a preferred form of stationary jaw assembly as shown in FIG. 1.
Figure 3:
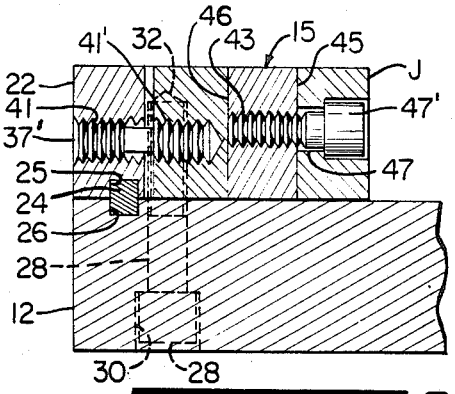
FIG. 3 is a cross-sectional view of the stationary jaw assembly and illustrating the installation of a soft jaw thereon.

Referring to FIGS. 1 to 3, there is illustrated a preferred form of jaw adaptor assembly 10 for interchangeable mounting of different selected vise jaws to a machine vise unit M. As a setting for the invention, one commercially available form of machine vise unit M is the ANGLOCK® system manufactured and sold by Kurt Manufacturing Company, of Minneapolis, Minn., and which is broadly comprised of a vise bed 12 having a flat rectangular upper surface 14 adapted for mounting of a fixed jaw member 15 and a movable jaw member 16. Although not shown, the jaw 16 is controlled in its slidable movement along the bed by a screw thread having a handle control 18. A spherical segment and thrust collar, also not shown, secures the sliding jaw 16 to the bed and is specifically designed to relieve bending stresses and upward lifting forces in heavy duty machining operations. The jaw member 16 is of standard construction with a front working surface 20 in facing relation to the fixed jaw 15, the working surface being flat and ground square.

The preferred form of jaw adaptor assembly 10 is comprised of an adaptor block 22 of elongated rectangular configuration affixed to one end of the upper bed surface 14 of the machine vise unit by a key member 24 positioned in aligned keyways 25, 26 between the adaptor block 22 and bed 12, the key member traversing the full length of the block 22 in a direction normal to the length of the bed 12. Connecting bolts 28 extend upwardly through vertical counterbores 30 at opposite sides of the bed 12 and into aligned, threaded bores 32 in the adaptor block 22. Preferably, the aligned bores 30 and 32 are disposed adjacent to opposite ends of the adaptor block just forwardly of the keyway 24 or, in other words, between the key 24 and jaw member 15. Tightening of the connecting bolts 28 will draw the adaptor block into flush abutting relation to the upper surface 14 of the bed, the keyway arrangement as described serving not only to properly locate and align the adaptor block on the bed as a preliminary to tightening but to absorb and directly transmit any clamping forces into the bed 12. The adaptor block 22 includes a front vertical surface 33 with a broad, vertically extending center groove 34 intruding into the surface 33, the groove having a flat base or inner surface portion 35 flanked by opposed, facing sides 36. The groove extends inwardly through the thickness of the adaptor block 22 to a depth substantially one-half the thickness of the block and is adapted to receive a squared end portion 37 of a mounting block insert 38. The insert 38 projects forwardly from the groove to terminate in a vertically extending, dovetail end portion 39 having tapered or pointed, vertically extending side edges 40 along opposite sides of a flat end surface 42. The insert 38 is adjustably mounted with respect to the groove 34 by a stem control member 37 provided with reverse threading 41 and 41' along its length, the stem being insertable through aligned threaded bores in the block 22 and insert 38 which aligned bores are of corresponding pitch to the reverse threaded portions 41 and 41', as best seen from FIG. 3. The stem 37 is provided with an allen head socket 37' in its exposed or rearward end to permit insertion of a wrench in order to impart the necessary movement to the insert 38 in causing it to be advanced in a direction out of the groove or to draw the insert into the groove such that the dovetail end portion is drawn against the vertical end surface 33 of the block.

The fixed jaw member 15 is a standard hard jaw of generally oblong or flat rectangular configuration having squared ends 44 and a front, flat working surface 45 provided with mounting holes 43 therein. A groove extends vertically through the center of rear surface 46, the groove being complementary to the dovetail end portion 39 and defined by an inner end surface 50 and laterally flared side edges 52. When the dovetail end portion 39 is extended as hereinbefore described, the groove may be passed vertically in close-fitting relation over the end portion 39 so that the end portion snugly fits into the groove. Once so positioned, the end portion 39 is retracted by threaded adjustment of the insert 38 so as to wedge the rear end surface 46 against the front surface 33 of the adaptor block 22.

The jaw member 15 is representative of various interchangeable jaws which are connectable to the adaptor block 22 as described, such as, for instance, the interchangeable vise jaws illustrated in FIGS. 5 to 17, depending upon the work to be performed. Set-up time in changing from one jaw member to another is reduced to a minimum in the preferred form of invention by obviating the use of threaded fasteners or the like between the working jaw and adaptor block; instead, it is merely necessary to loosen the insert 38, slide the jaw upwardly to separate it from the insert and replace it with another vise jaw which is assembled to the adaptor block in the manner described with respect to the jaw 15. As further illustrated in FIG. 3, the mounting holes 43 in the jaw member 15 facilitate attachment of a machinable soft jaw J which similarly is provided with mounting holes 47 alignable with the mounting holes 43 in the jaw 15 for insertion of fasteners 47' to affix the soft jaw J to the jaw member 15. The soft jaw J is a standard shop item and can be machined to hold and locate innumerable different shaped parts for machining purposes.

Figure 4:
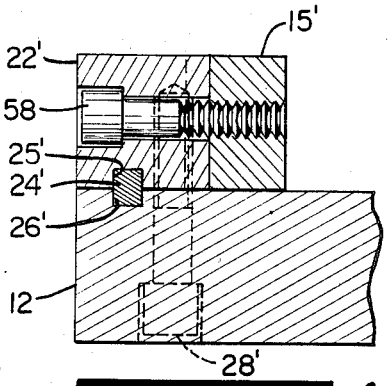
FIG. 4 is a cross-sectional view of a modified form of stationary jaw assembly.
Figure 5:
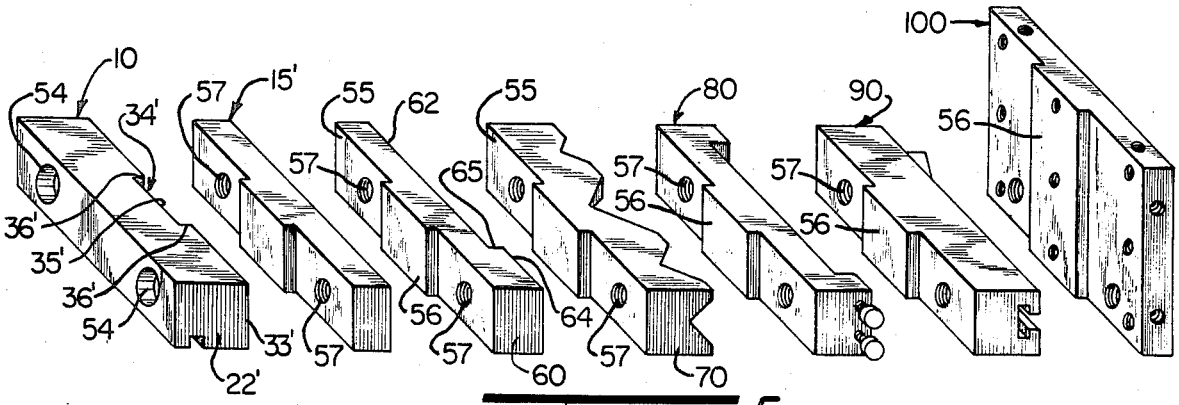
FIG. 5 is a perspective exploded view illustrating a plurality of interchangeable vise jaws conformable for use in the modified jaw assembly of the invention.

A modified form of invention is illustrated in FIGS. 4 and 5 in which like parts to the those of the preferred form of invention illustrated in FIGS. 1 to 3 are correspondingly enumerated. Thus, an adaptor block 22' is supported on a vise bed 12 with a keyway 25' aligned with a mating keyway 26 for insertion of a key member 24. Again, connecting bolts 28' extend upwardly through vertical bores 30 and into aligned threaded bores 32 at opposite ends of the adaptor block 22', the bores 30, 32 being disposed near opposite ends of the adaptor block just forwardly of the key 24. The connecting bolts 28 are tightened to draw the adaptor block 22' into flush engagement with the upper surface 14 of the bed 12. Again, the adaptor block 22' has a front vertical surface 33' but in the modified form a relatively shallow center groove 34 intrudes into the vertical surface 33' for the direct alignment and connection of a master jaw member 15 in a manner to be described. The groove 34' is defined by an inner flat surface portion 35' flanked by opposed, facing side surfaces 36'. Spaced throughbores 54 extend horizontally through the adaptor blocks on opposite sides or just outwardly of the center groove to cooperate with the center groove 34' in a manner to be described in effecting connection of a selected jaw member. For example, FIG. 5 illustrates a series of interchangeable jaws including a master jaw 15', right angle jaw 60, V-block jaw 70, multiple parts jaw 80, multiple angle jaw 90 and an angle plate jaw 100 for interchangeable mounting to an adaptor block 22'. Each jaw is correspondingly formed with a rear end surface 55, a broad flat, centrally located rib 56 corresponding in size and shape to the center groove 34' and laterally spaced bores 57 which are alignable with the throughbores 54 in the adaptor block. Each of the bores 57 is threaded for threaded insertion of a connecting bolt 58 which is passed through the bore 54 and into threaded engagement with one of the bores 57 so as to draw the jaw into flush abutting relation to the front end surface 33' and groove 34' of the adaptor block.

In FIG. 5, right angle vise jaw 60 has a flat, vertical workpiece-engaging surface 62 opposite to the attaching end surface 55; and a vertical, stepped portion 64 having a shoulder 65 at right angles to the workpiece-engaging surface 62 which projects forwardly at one end of the vise jaw so as to be offset laterally from the rib 56 but extend parallel to the rib. The workpiece-engaging surface 62 of the jaw 60 as well as the stepped portion 64 are ground perpendicular to the base and find particular utility in machining work square and perpendicular; the stepped portion and particularly the shoulder 65 can also function as a stop.

Figure 6:
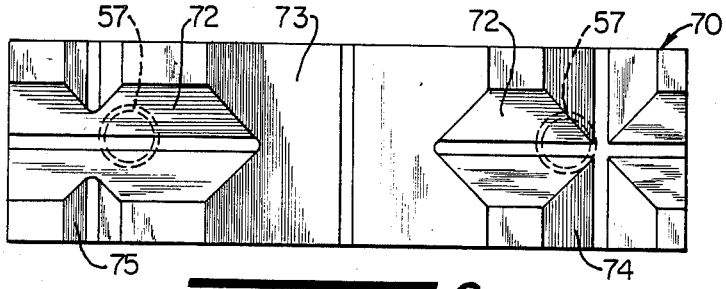
FIG. 6 is a front view in elevation and enlarged of a V-block vise jaw in accordance with the present invention.
Figure 7:
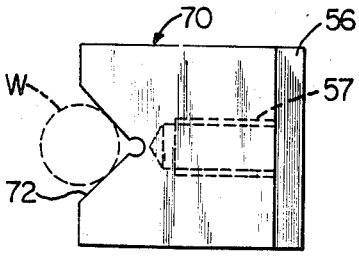
FIG. 7 is an end view of the vise jaw illustrated in FIG. 6.
Figure 8:
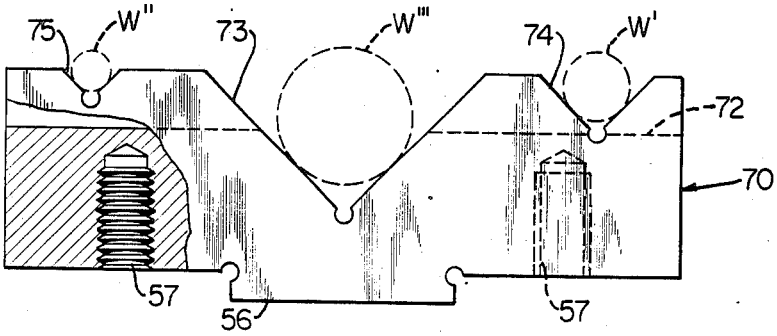
FIG. 8 is a top plan view of the vise jaw illustrated in FIG. 6.

There is illustrated in more detail in FIGS. 6 to 8 the vise jaw 70 in which the workpiece-engaging surface opposite to the attaching end surface 55 is defined by a plurality of V-shaped slots of varying depths to accommodate different sized rounded and hexagonal shaped workpieces. A medial, relatively shallow slot 72 extends horizontally to traverse the length of the vise jaw and is intersected by a relatively deep, vertical slot 73 which is centered with respect to the rib 56 and extends substantially one-half the total thickness of the vise jaw 70. Flanking the slot 73 are a first vertical slot 74 adjacent to one end of the vise jaw and which has a depth substantially corresponding to the medial slot 72, and a shallower slot 75 adjacent to the opposite end of the vise jaw which has a depth approximately one-half of the medial slot 72. As illustrated, different sized workpieces W, W', W'' and W''', as illustrated in dotted form, can be positioned into one of the selected slots according to the size of the workpiece. When so positioned, the movable jaw is advanced into clamping engagement with the workpiece so as to effectively establish a three-point contact between the flat surface 20 of the movable jaw 16 and the two sides of the Vee.

Figure 9:
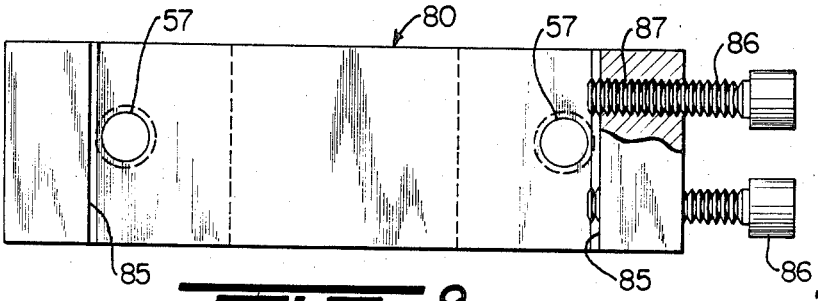
FIG. 9 is a front view in elevation and enlarged of a preferred form of multiple parts jaw adapted for interchangeable use in the modified form of machine vise unit of the present invention.
Figure 10:
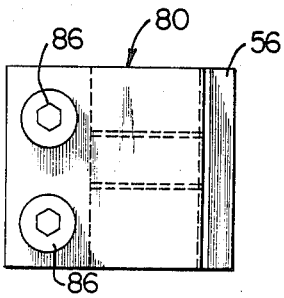
FIG. 10 is an end view of the vise jaw illustrated in FIG. 9.
Figure 11:
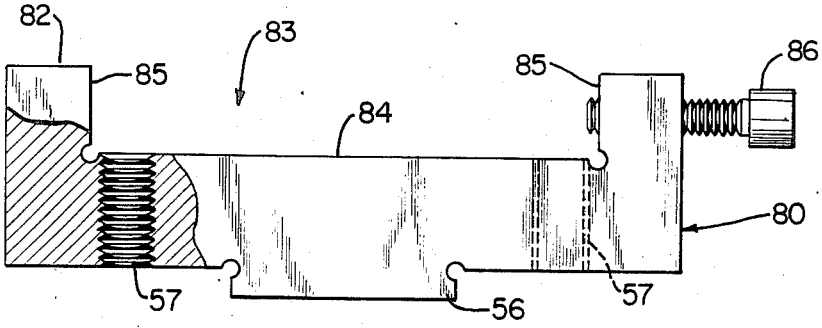
FIG. 11 is a top plan view of the vise jaw illustrated in FIG. 9.

The multiple parts jaw 80 is illustrated in more detail in FIGS. 9 to 11 and is particularly useful in gang machining a number of parts while holding the parts square. To this end, a workpiece-engaging surface 82 is formed with a relatively broad, U-shaped vertical channel 83 having a flat inner end surface 84 and opposite sides 85 in facing relation to one another and adjacent to opposite ends of the vice jaw 80. A pair of upper and lower bolt members 86 are threadedly inserted through bores 87 to extend inwardly from the one end of the jaw 80 for advancement into the channel in a direction parallel to the end surface 84. In this way, a series of parts may be arranged between the clamping bolts 86 and opposite side 85 for gang machining operations. Accordingly, the threaded ends of the bolts 86 will bear against the parts from one end so as to clamp them against the opposite end while the movable jaw member 16 will exert pressure in clamping the parts between the end surface 20 and inner end 84 of the channel 83.

Figure 12:
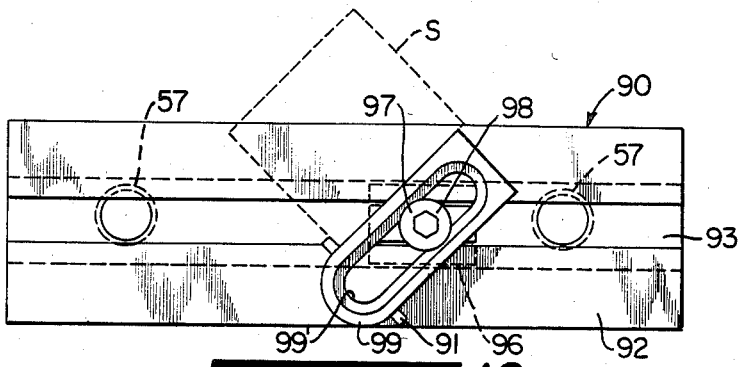
FIG. 12 is a front view in elevation and enlarged of a multiple angle vise jaw in accordance with the present invention.
Figure 13:
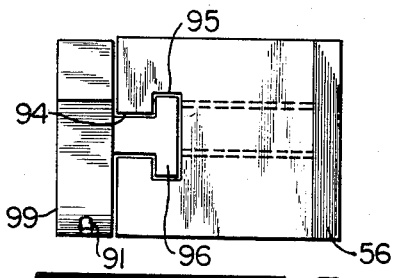
FIG. 13 is an end view of the vise jaw illustrated in FIG. 12.
Figure 14:
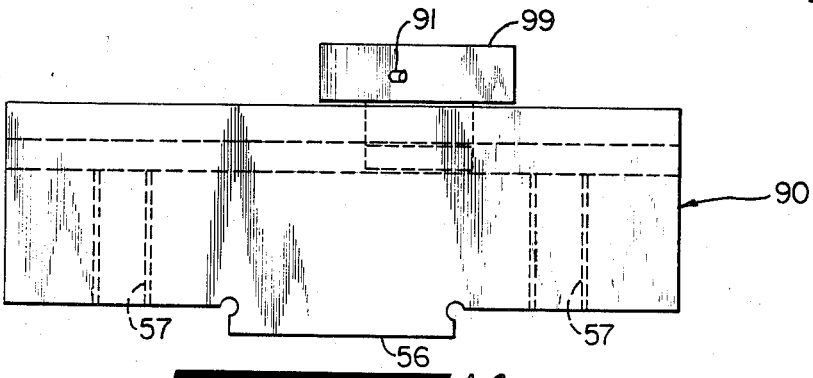
FIG. 14 is a top plan view of the vise jaw illustrated in FIG. 12.

Another unique form of jaw is illustrated in FIGS. 12 to 14, taking the form of a multiple angle jaw 90. The jaw 90 is specifically adaptable for machining work with angles or chamfers and includes a flat workpiece-engaging surface 92 having a horizontally directed channel 93 which traverses the length of the jaw 90 and which in cross-section is of generally T-shaped configuration including a stem portion 94 and cross portion 95. The stem portion of the Tee forms a relatively narrow entrance into the broader cross portion 95 and is adapted to accommodate a Tee nut 96 which is slidable horizontally through the channel. The Tee nut 96 includes a threaded end portion 97 projecting forwardly beyond the workpiece-engaging surface 92 for threaded connection of a nut 98. An angle setting arm 99 includes a central elongated slotted area 99′ through which the Tee nut extends whereby tightening of the nut will permit angularly adjustable setting of the arm 99 at different angles. A transverse pin 91 extends through one end of the arm to serve as a stop member so that when the arm is positioned at the desired angle the workpiece or part may be disposed to rest along one surface of the arm and against the pin 91. Preferably, the pin 91 projects beyond opposite sides of the arm so as to be capable of serving as a limit stop irrespective of the angular disposition of the arm or, in other words, to permit positioning of the workpiece along either side of the arm 99 and against one of the projecting ends of the pin.

Figure 15:
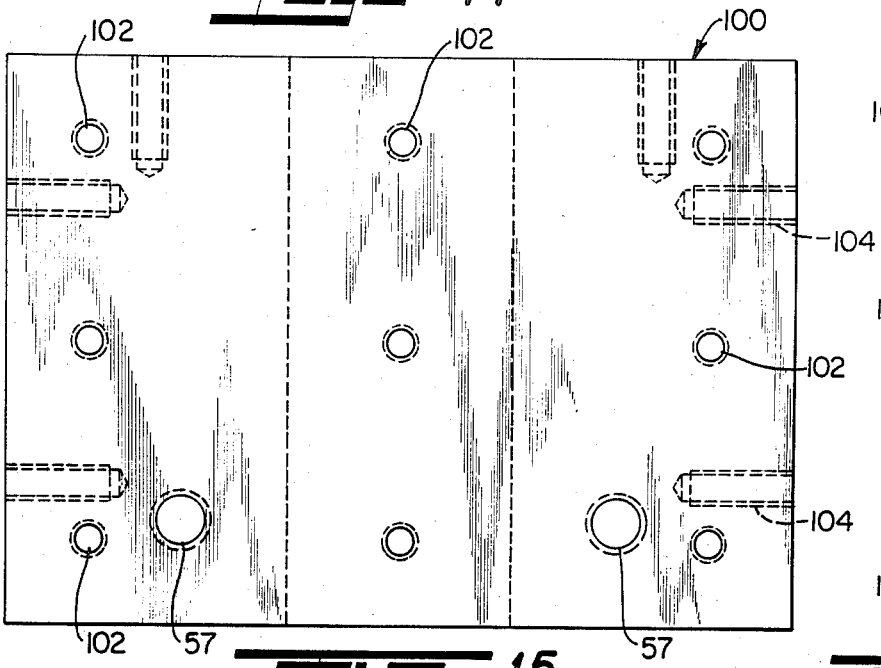
FIG. 15 is a front view in elevation and enlarged of an angle plate vise jaw in accordance with the present invention.
Figure 16:
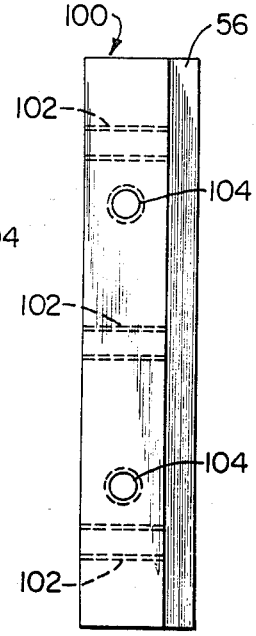
FIG. 16 is a side view of the vise jaw illustrated in FIG. 15.
Figure 17:
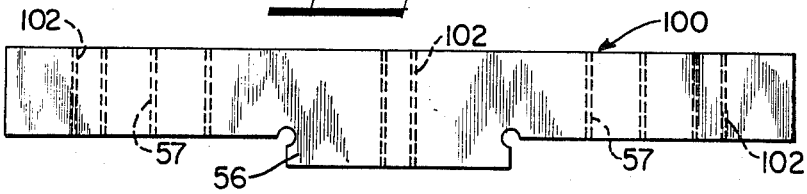
FIG. 17 is a top plan view of the unit shown in FIGS. 15 and 16.

There is illustrated in FIGS. 15 to 17 an extremely versatile form of angle plate jaw 100 and which is adaptable for use in machining a wide variety of medium-sized angle plate and squaring work. A particular advantage is that the vise jaw converts the vise to an angle plate without taking the vise off the machine and mounting special angle plates. To this end, the angle plate jaw 100 takes the form of a broad rectangular plate having a series of tapped mounting holes 102 extending at spaced intervals through the thickness of the plate in order to accommodate a variety of different clamping members or plates which can be suitably secured to the face of the jaw 100 by connecting bolts inserted into the holes 102. Similarly, tapped mounting holes 104 extend into the top and sides of the angle plate, for instance, to permit mounting of stop elements.

In the vise jaws as herein described with respect to FIGS. 5 to 17, each attaching end surface 55 is correspondingly formed with a rib 56 and connecting bores 57 for interchangeable mounting on the adaptor block 22′. It will be readily apparent that the vise jaws may be formed with attaching end surfaces corresponding to the master jaw 15 for interchangeable mounting by the insert 38 to the adaptor block.

It is therefore to be understood that various modifications and changes may be made in the method and apparatus of the present invention as well as its intended application and use without departing from the spirit and scope of the present invention as defined by the appended claims.

We claim:

1. In a machine vise unit having a vise jaw support bit, the improvement comprising:

first and second jaws mounted on said vise jaw support bed in facing relation to one another, each of said jaws being elongated in a direction transversely of said bed, said second jaw slidably mounted on said bed for movement toward and away from said first jaw, means for mounting said first jaw in fixed relation to one end of said bed including an elongated adaptor block having a key member mounted on one of said adaptor block and said bed and extending through a keyway in the other of said adaptor block and said bed in a direction parallel to the length of said adaptor block and normal to the length of said bed; and mounting means between said first jaw and said adaptor block including an interfitting complementary rib and groove for fixedly mounting said first jaw to said adaptor block with a workpiece-engaging surface on said first jaw disposed in facing relation to said second jaw, said mounting means between said adaptor block and said first jaw defined by a vertically extending dovetail groove in said first jaw, a mounting block insert in a groove in said adaptor block, said insert having a dovetail end portion projecting away from said adaptor block complementary to said dovetail groove in said first jaw, and adjustable connecting means between said mounting block insert and said adaptor block operative to slide said dovetail end portion towards the groove in said adaptor block to draw said first jaw into clamping engagement with said adaptor block when said dovetail end portion is mounted in said dovetail groove such that said first jaw is advanced into flush abutting relation to said adaptor block.

2. In a machine vise unit according to claim 1, said adjustable connecting means between said first jaw and said adaptor block including at least one threaded fastener member extending horizontally between said adaptor block and said insert.

3. In a machine vise unit according to claim 1, said dovetail end portion diverging away from said adaptor block and terminating in a flat end surface.

4. In a machine vise unit according to claim 1, said key member extending through aligned keyways between said adaptor block and said bed and being coextensive with the length of said adaptor block.

5. In a machine vise unit according to claim 1, a plurality of interchangeable vise jaws, each said vise jaw having an attaching end surface and means for releasably attaching each said vise jaw ot said adaptor block.

6. In a machine vise unit according to claim 1, said dovetail end portion having dovetail members projecting laterally away from opposite sides of said mounting block insert.

7. In a machine vise unit according to claim 6, said dovetail members having front edges forming continuations of a forward vertical end surface of said mounting block insert and trailing edges tapering rearwardly away from said front edges into said opposite sides of said mounting block insert.

8. In a machine vise unit according to claim 5, one of said vise jaws having a flat, vertical workpiece-engaging surface opposite to said attaching end surface.

9. In a machine vise unit according to claim 5, said workpiece-engaging surface including a vertical stepped portion extending parallel to said dovetail groove on said attaching end surface.

10. In a machine vise unit according to claim 5, one of said vise jaws including a workpiece-engaging surface on a side opposite to said attaching end surface provided with a plurality of V-shaped slots therein.

11. In a machine vise unit according to claim 10, there being a pair of slots extending in mutually perpendicular relation to one another, one of said slots extending vertically in spaced parallel relation to said dovetail groove on said attaching end surface.

12. In a machine vise unit according to claim 11, at least one of said slots being of a greater depth than the other of said slots.

13. In a machine vise unit according to claim 5, one of said vise jaws being a multiple parts jaw having a workpiece-engaging surface of generally U-shaped configuration provided with opposite sides extending in a direction away from said attaching end surface, one of said opposite sides provided with adjustable clamping members thereon.

14. In a machine vise unit according to claim 13, said adjustable clamping members defined by bolts threadedly inserted through openings in said side for extension in a direction toward said opposite side.

15. In a machine vise unit having a vise jaw support bit, the improvement comprising:

first and second jaws mounted on said vise jaw support bed in facing relation to one another, each of said jaws being elongated in a direction transversely of said bed, said second jaw slidably mounted on said bed for movement toward and away from said first jaw, means for mounting said first jaw in fixed relation to one end of said bed including an elongated adaptor block having a key member mounted on one of said adaptor block and said bed and extending through a keyway in the other of said adaptor block and said bed in a direction parallel to the length of said adaptor block and normal to the length of said bed; and mounting means between said first jaw and said adaptor block including an interfitting complementary rib and groove for fixedly mounting said first jaw to said adaptor block with a workpiece-engaging surface on said first jaw disposed in facing relation to said second jaw, said first jaw being a multiple angle jaw for machining work with angles or chamfers, said workpiece-engaging surface including a horizontal channel, a shaped T-nut slidably inserted in said channel, said shaped T-nut provided with a threaded stem projecting forwardly through said channel, and an angle-setting arm threadedly connected to said stem.

16. In a machine vise unit according to claim 15, said angle setting arm inc1uding a stop member adjacent to one end of said arm.

17. In a machine vise unit according to claim 15, one of said first and second jaw members being an angle plate jaw having a workpiece-engaging surface provided with tapped mounting holes at spaced intervals therein, said angle plate jaw beingof generally rectangular configuration and of a height greater than said adaptor block.

18. In a milling machine having a vise jaw support bed, the improvement comprising:

a slidable jaw mounted on said vise jaw support bed, said slidable jaw slidably mounted on said bed for movement toward and away from one end of said bed;

an adaptor block fixedly mounted at the one end of said bed including a vertical groove on its facing surface having a flat base and opposed facing sides, a mounting block insert having a dovetail end surface and an opposed squared end surface, said squared end surface complementary to said vertical groove on said adaptor block, and adjustable connecting means between said adaptor block and said mounting block insert to position said squared end surface in said groove for adjustable sliding movement of said dovetail end surface toward and away from said groove; and at least one interchangeable vise jaw, each said vise jaw having a flat attaching end surface with a vertical dovetail groove therein of the same cross-section as said dovetail end surface for releasable insertion of said dovetail end surface therein, said adjustable connecting means being operative in sliding said dovetail end surface toward said groove to draw said vise jaw mounted on said dovetail end surface into clamping engagement with said adaptor block such that said attaching end surface is advanced into flush abutting relation to said facing surface of said adaptor block.

19. In a milling machine according to claim 18, said dovetail end surface having dovetail members projecting laterally away from opposite sides of said mounting block insert.

20. In a milling machine according to claim 19, said dovetail members having front edges forming continuations of a forward vertical end surface of said mounting block insert and trailing edges tapering rearwardly away from said front edges into said opposite sides of said mounting block insert.

* * * * *